United States Patent [19]

Faulkner

[11] 4,112,325

[45] Sep. 5, 1978

[54] ELECTRON DISCHARGE TUBE HAVING A CUP-SHAPED SECONDARY ELECTRON EMISSIVE ELECTRODE

[75] Inventor: Richard Dale Faulkner, Lancaster, Pa.

[73] Assignee: RCA Corporation, New York, N.Y.

[21] Appl. No.: 813,075

[22] Filed: Jul. 5, 1977

Related U.S. Application Data

[63] Continuation of Ser. No. 655,166, Feb. 4, 1976, abandoned.

[51] Int. Cl.[2] ..... H01J 39/04; H01J 43/10; H01J 43/26

[52] U.S. Cl. ..... 313/95; 313/105 R

[58] Field of Search ..... 313/94, 95, 99, 102, 313/103, 104, 105, 101

[56] References Cited

U.S. PATENT DOCUMENTS

| | | | |
|---|---|---|---|
| 2,824,253 | 2/1958 | Fong et al. | 313/105 |
| 3,119,038 | 1/1964 | Raffan | 313/103 |
| 3,684,910 | 8/1972 | Stutzman et al. | 313/105 |
| 3,849,644 | 11/1974 | Ibaugh | 313/105 |
| 3,875,441 | 4/1975 | Faulkner | 313/105 |
| 4,006,376 | 2/1977 | Faulkner et al. | 313/103 X |

*Primary Examiner*—Robert Segal
*Attorney, Agent, or Firm*—E. M. Whitacre; G. H. Bruestle; R. M. Rodrick

[57] ABSTRACT

An evacuated tube has a face plate and a tubular body with at least a portion of the body having a circular cross section. In the evacuated tube is an electron emissive electrode adapted to release electrons in response to impinging photons or photoelectrons, means for collecting the electrons and an anode. The electron emissive electrode is cup shaped, having an approximate circular top opening through which photons or photoelectrons enter to impinge on the electrode, a circular rim around the periphery of the top opening, and a side opening through which the electrons pass to exit from the electrode. The inside of the electrode is lined with electron emissive material. The electrode is positioned in the portion of the tubular body having the circular cross section with the rim of the electrode substantially parallel to the plane of the circular cross section and having a diameter substantially the same as the diameter of the circular cross section, and with the top opening of the electrode facing the face plate. The means for collecting the electrons is positioned laterally adjacent to the electrode between the side opening and the tubular body.

14 Claims, 5 Drawing Figures

ELECTRON DISCHARGE TUBE HAVING A CUP-SHAPED SECONDARY ELECTRON EMISSIVE ELECTRODE

This is a continuation of application Ser. No. 655,166, filed Feb. 4, 1976, now abandoned.

BACKGROUND OF THE INVENTION

The present invention relates to electron emissive electrodes used in electron discharge tubes and more particularly to an electrode with a very large area of electron emissive material.

Electron emissive electrodes are used in electron discharge tubes to emit a plurality of electrons in response to each impinging photon or photoelectron. Because of this property, electron multipliers are made utilizing these electrodes. The primary electrons can be photoelectrons from a photocathode or secondary electrons from another dynode. The problem that has been encountered in the construction of phototubes has been to collect efficiently electrons from one stage of an electron multiplier to another stage. In particular the problem has been to maximize the collection of electrons at the input stage of the electron multiplier, i.e., photoelectrons from a photocathode to the first dynode of an electron multiplier. An increase in the efficiency of collection of electrons at the input stage increases the signal-to-noise ratio. Thus, it is highly desirable to collect all the electrons that can be collected. For a photomultiplier tube this means the maximization of the collection of photoelectrons from the photocathode.

Cup shaped electron emissive electrodes are known in the art (see e.g. U.S. Pat. No. 3,849,644 issued to James Ibaugh on Nov. 19, 1974). However, that patent teaches the angular staggering of the cup shaped electrodes. This results in an electron discharge tube having a large axial dimension to accomodate the "staggered" electrodes.

SUMMARY OF THE INVENTION

An electron discharge tube comprises an evacuated tube having a face plate and a tubular body, with a portion of the body having a circular cross section. In the tube is an electron emissive electrode adapted to release electrons in response to impinging photons or photoelectrons, means for collecting the electrons and an anode. The electrode is shaped in a cup having an approximate circular top opening through which photons or photoelectrons enter to impinge on the electrode. A circular rim is around the periphery of the top opening. The circular rim has a diameter substantially the diameter of the circular cross section of the tubular body. Electron emissive material is on the inside of the electrode. The electrode has a side opening. Electrons released from the electron emissive material pass through the side opening to exit from the electrode. The electrode is positioned in the tube in the portion of the tubular body having the circular cross section, with the rim of the electrode substantially parallel to the plane of the circular cross section and with top opening of the electrode facing the face plate. The means for collecting the electrons is positioned laterally adjacent to the electrode between the side opening and the body.

DETAILED DESCRIPTION OF THE DRAWINGS

Figure 1:
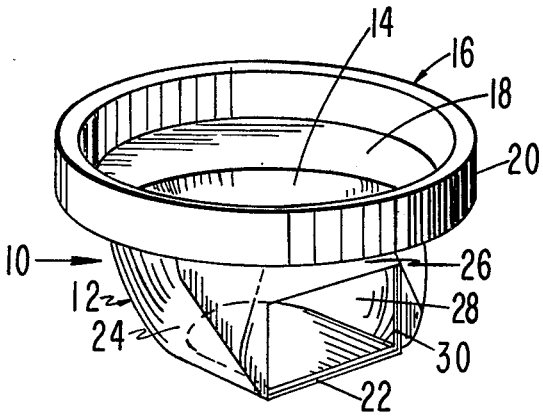
FIG. 1 is a perspective view of an electron emissive electrode used in the electron discharge tube of the present invention.
Figure 2:
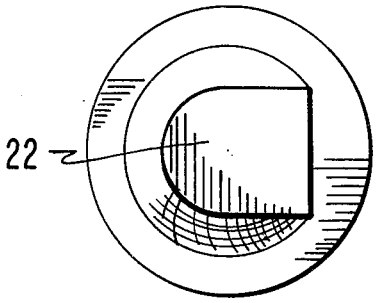
FIG. 2 is a plan view of the base of the electrode of FIG. 1.

Referring to FIG. 1, there is shown an electron emissive electrode, generally designated as 10, used in the electron discharge tube of the present invention. In the preferred embodiment the electrode 10 comprises a cup shaped member 12 with an approximate circular top opening 14. A flange 16 is around the periphery of the top opening 16. The flange 16 comprises a rim 18, extending substantially in a radial direction from the cup shaped member 12, and an axial member 20 extending substantially in an axial direction from the cup shaped member 12. The cup shaped member 12 includes a flat base 22 and a side wall 24 enclosing the base 22. The base 22 is shaped in an area defined by a rectangle and a semicircle next to one of the sides of the rectangle. The semicircle has a diameter equal to one side of the rectangle (as shown in FIG. 2). The side wall 24 has a flat region 26 extending from the base 22 to the top opening 14 substantially perpendicular to the top opening 14. A side opening 28 is in the flat region 26. The side opening 28 is rectangular in shape with one of the edges of the rectangular opening on the base 22. Preferably one of the edges of the rectangular opening is the side of the base 22 opposite the semicircle. The inside of the cup shaped member 12 is lined with electron emissive material 30. Although the cup shaped electrode 10 in the preferred embodiment is shown as having a flat base 22, the cup shaped member 12 can be round or of any desired shape. In addition, the side wall 24 need not have a flat region 26. The cup shaped member 12 can be made from any electrically conducting material, such as a metal. The cup shaped electrode 10 can be made by any suitable method, such as stamping with a die.

Figure 3:
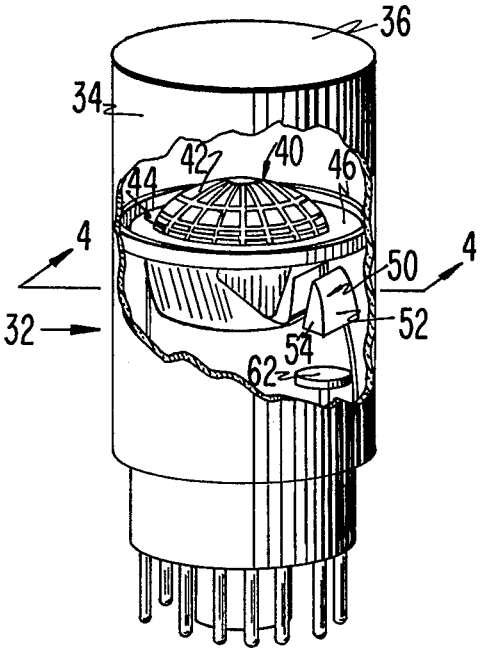
FIG. 3 is a cutaway perspective view of an electron discharge tube of the present invention.

Referring to FIG. 3 there is shown the electrode 10 used in an electron discharge tube 32 of the present invention. The electrode 10 is used as a dynode, in the electron discharge tube 32. In the preferred embodiment the electron discharge tube 32 comprises a cylindrical body 34 and a circular face plate 36. Within the tube 32 is a photocathode 38 on the face plate 36 and along a portion of the cylindrical body 34 adjacent to the face plate 36 (see FIG. 4). The cup dynode 10 is positioned in the tube 32 spaced apart from the photocathode 38 such that the top opening 14 faces the photocathode 38 on the face plate 36, and such that the rim 18 is substantially parallel to the plane of the circular face plate 36. The diameter of the rim 18 is substantially the diameter of the cross section of the cylindrical body 34. A cavity is formed by the side opening 28, the rim 18, and the cylindrical body 34. Although the electron discharge tube 32, as shown in FIG. 3, comprises a cylindrical body 34, the electron discharge tube 32 need only comprise a tubular body with a portion of the tubular body having a circular cross section and with the cup dynode 10 positioned in the circular cross-section portion.

A mesh 40 is over the top opening 14 of the cup dynode 10. The mesh 40 is dome shaped and is radially symmetric. The mesh 40 comprises two portions, a central portion 42 and a peripheral portion 44. The mesh 40 is positioned over the top opening 14 of the cup dynode 10 such that the central portion 42 is closer to the photocathode 38 than the peripheral portion 44. The mesh 40 comprises a network of radial and circumferential elements intersecting to form openings of non-uniform sizes. In the central portion 42, the mesh 40 is more electron permeable than the peripheral portion 44 of the mesh 40, i.e. the size of the openings in the central portion 42 is larger than the size of the openings in the peripheral portion 44. The mesh 40 also includes an annular ring 46 attached around the peripheral portion 44 for support purpose. The annular ring 46 rests on the flange 16 of the cup dynode 10. The radial and circumferential elements are of electrically conducting material, such as a metal. The annular ring 46 can also be of an electrically conducting material, preferably the same metal as is used for the radial and circumferential elements. The mesh 40 can be made by etching apertures in a planar metal member. The etched planar metal member is then stretched to achieve the dome shape.

A box and grid dynode 50 is also in the electron discharge tube 32. The box and grid dynode 50 comprises a curved surface 52, two side walls 54 each attached perpendicularly to the curved surface 52 (only one side wall is shown in FIG. 3), and a planar grid 56 attached to the curved surface 52 and the two side walls 54 (see FIG. 4). A bottom opening 58 is formed by the grid 56, the two side walls 54 and the curved surface 52. Electron emissive material 60 (see FIG. 4) is on the interior surface of the curved surface 52. The planar grid 56 is a network of mutually orthogonal elements intersecting to form non-uniform openings. The plane grid 56 is less electron permeable near the curved surface 52 than at the bottom opening 58, i.e. the openings of the grid 56 are smaller near the curved surface 52 than the openings near the bottom opening 58. The box and grid dynode 50 can be made from any electrically conducting material, such as a metal.

The box and grid dynode 50 is positioned in the cavity formed by the side opening 28, the rim 18, and the cylindrical body 34 such that the grid 56 lies substantially parallel to the side opening 28 of the cup dynode 10. Preferably, the box and grid dynode 50 lies between the rim 18 of the cup dynode 10 and base 22 of the cup dynode 10, with the bottom opening 58 in the same plane as the base 22. Finally, an anode 62 is in the tube 32 aligned directly under the bottom opening 58 of the box and grid dynode 50.

Figure 4:
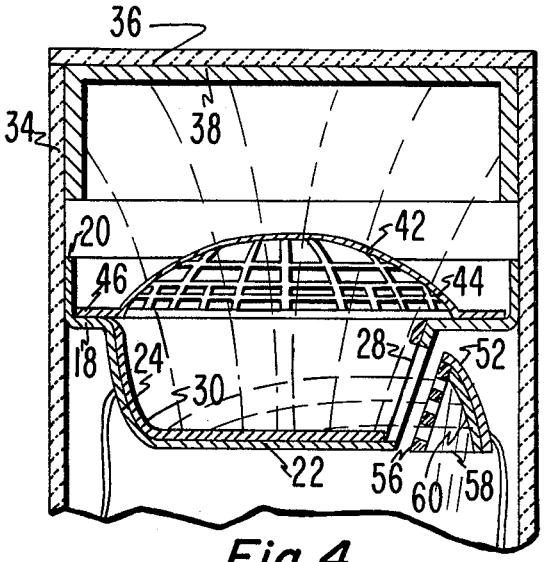
FIG. 4 is a cross-sectional view taken along plane 4—4 of FIG. 3 of a portion of the electron discharge tube.

Referring to FIG. 4, there is shown a cross sectional view of the electron discharge tube 32 of FIG. 3 illustrating its mode of operation. As it is well known to one skilled in the art, a potential must be applied between the photocathode 38 and the cup dynode 10 to attract photoelectrons released by the photocathode 38. The mesh 40, in contact with the cup dynode 10 will have the same potential as the cup dynode 10. Photoelectrons are ejected from the photocathode 38 by impinging photons and traverse paths shown by the dotted lines. The photoelectrons pass through the mesh 40 and the top opening 14 of the cup dynode 10 to strike the electron emissive material 30 on the side wall 24 and on the base 22 of the cup dynode 10. The function of the mesh 40 is to permit the passage of photoelectrons through the mesh 40 to impinge on the electron emissive material 30 of the cup dynode 10. However, the mesh 40 must also shield the secondary electrons, released by the electron emissive material 30, from the field of the photocathode 38. Thus it is at the same potential as the cup dynode 10. By enlarging the size of the openings in the central portion 42 of the mesh 30, the former function is accomplished. However, because the openings of the central portion 42 are enlarged, they also permit a larger amount of the field from the photocathode 38 to interact with the secondary electrons, inhibiting their passage onto the next electrode. Thus, the mesh 40 is dome shaped, to move the central portion 42 further away from the dynode 10, to reduce the effect on the secondary electrons as a result of having enlarged the openings in the central portion 42.

Secondary electrons are released by the cup dynode 10 from the electron emissive material 30 along the side wall 24 and along the base 22 and are directed to the box and grid dynode 50. The secondary electrons are attracted by a potential between the cup dynode 10 and the box and grid dynode 50; they traverse paths shown by the dotted lines. These secondary electrons pass through the side opening 28 and the grid 56 to impinge on the curved surface 52. The primary electrons of the cup dynode 10, i.e. the photoelectrons, traverse paths substantially in axial direction of the electron discharge tube 32 whereas the secondary electrons of the dynode 10 traverse paths substantially in the radial direction of the electron discharge tube 32.

At the box and grid dynode 50, the secondary electrons released by the cup dynode 10 become the primary electrons to the box and grid dynode 50. The primary electrons of the box and grid dynode 50 strike the interior surface of the curved surface 52 on which is the electron emissive material 60. The secondary electrons, released by the electron emissive material 60 on the curved surface 52, traverse through the bottom opening 58 and impinge on a succeeding electrode, such as an anode 62. The primary electrons of the box and grid dynode 50 traverse paths substantially in the radial direction of the electron discharge tube 32 and the secondary electrons of the box and grid dynode 50 traverse paths substantially in the axial direction of the electron discharge tube 32.

As it was indicated earlier, the problem that had been encountered in the construction of electron discharge tubes has been to collect efficiently electrons from one stage of an electron multiplier to another stage, and in particular the problem has been to maximize the collection of electrons at the input stage of the electron multiplier. In the electron discharge tube 32 of the present invention, the cup dynode 10 has a very large area to collect impinging photoelectrons. The particular advantage of the cup dynode 10 is that it maximizes the collection of photoelectrons ejected by the photocathode 28 along the face plate 36 and along the evacuated envelope 34. Thus, an improvement in the signal to noise ratio results. Moreover, the top opening 14 through which photoelectrons can impinge upon the cup dynode 10, can be made as large as the cross sectional area of the cylindrical body 34, to maximize the collection of the photoelectrons. Thus, a large area to intercept photoelectrons is possible with the tube 32 of the present invention.

Finally, unlike the cup electrodes described in U.S. Pat. No. 3,849,644, the electron discharge tube of the present invention does not use angularly "staggered" electrodes. The box-and-grid dynode 50, positioned laterally adjacent to the cup dynode 10, permits the electron discharge tube 32 to have a shorter axial dimension than a similar electron discharge tube using angularly staggered electrodes. Thus, saving in size is also achieved.

Figure 5:
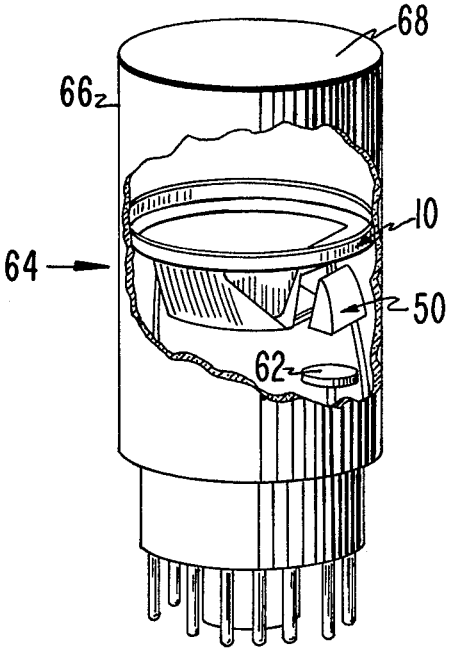
FIG. 5 is a cut away perspective view of another electron discharge tube of the present invention.

Referring to FIG. 5 there is shown an electron discharge tube 64, using the electron emissive electrode 10. The electron discharge tube 64 is the same as the electron discharge tube 32 except with the omission of the photocathode 38 and of the mesh 40. In the electron discharge tube 64 the electron emissive electrode 10 acts as a photocathode, i.e. the electron emissive electrode 10 emits electrons in response to impinging photons.

In all other aspects, the limitations and advantages of the electron discharge tube 32, of FIG. 3 are also present in the electron discharge tube 64.

What is claimed is:

1. An electron discharge tube comprising:

(a) an evacuated tube having a faceplate and a tubular body, with a portion of the body having a substantially circular cross-section;

(b) a cup-shaped electron emissive electrode having:

i. a substantially circular top opening;

ii. a base;

iii. a sidewall;

iv. a substantially circular rim around the periphery of said top opening, said rim projecting outward radially from said sidewall and terminating in flange having a diameter substantially equal to the diameter of the substantially circular cross-section;

v. an electron emissive coating on the inside of said cup-shaped electrode adapted to release electrons in response to impinging photons or photoelectrons; and vi. a side opening in said sidewall through which said electrons pass to exit from said cup-shaped electrode;

(c) said electrode positioned in the portion of the body having the substantially circular cross-section with said projecting rim substantially parallel to the plane of the substantially circular cross-section, and with said top opening facing said faceplate;

(d) means for collecting said electrons, said means positioned laterally adjacent said cup-shaped electrode between said side opening and said body; and (e) an anode.

2. The electron discharge tube of claim 1 wherein said side wall, said rim and said tubular body form a cavity; and said means for collecting said electrons is positioned in said cavity.

3. The electron discharge tube of claim 2 wherein the base of said cup-shaped electrode is substantially flat.

4. The electron discharge tube of claim 3 wherein said sidewall has a substantially flat region extending from said base to said top opening and wherein said side opening is in said substantially flat region.

5. The electron discharge tube of claim 4 wherein said side opening is near the periphery of said top opening and is substantially perpendicular to said top opening.

6. The electron discharge tube of claim 5 wherein said base is a shape defined by a rectangle and a semicircle adjacent to the rectangle; and said semicircle having a diameter equal to one side of said rectangle.

7. The electron discharge tube of claim 6 wherein said side opening is rectangular in shape.

8. The electron discharge tube of claim 7 wherein one edge of said side opening lies on the base.

9. The electron discharge tube of claim 8 wherein said one edge of said side opening is a side of the base opposite the one side.

10. The electron discharge tube of claim 9 wherein said collecting means is a box and grid dynode having a curved surface;

two side walls each attached perpendicularly to the curved surface;

a planar grid attached to the curved surface and the two side walls;

a bottom opening formed by the grid, the two side walls and the curved surface; and electron emissive material on the interior surface of the curved surface.

11. The electron discharge tube of claim 10 wherein said box and grid dynode is positioned between the rim of the cup shaped electrode and a plane of the base of the cup shaped electrode, and said grid adjacent and substantially parallel to said side opening of said cup shaped electrode.

12. The electron discharge tube of claim 11 wherein said bottom opening lies in the plane of the base of the cup shaped electrode.

13. The electron discharge tube of claim 12 wherein said electrode is a photocathode, emitting photoelectrons in response to impinging photons.

14. The electron discharge tube of claim 12 wherein said electrode is a dynode, emitting electrons in response to impinging electrons; and a photocathode in said tube on said face plate.

* * * * *